US006367304B1

(12) United States Patent
Fahrenbach

(10) Patent No.: US 6,367,304 B1
(45) Date of Patent: Apr. 9, 2002

(54) FORMING MACHINE WITH COOLING APPARATUS

(75) Inventor: Jürgen Fahrenbach, Aichelberg (DE)

(73) Assignee: Schuler Pressen GmbH & Co. KG, Göppingen (DE)

( * ) Notice: Subject to any disclaimer, the term of this patent is extended or adjusted under 35 U.S.C. 154(b) by 0 days.

(21) Appl. No.: 09/658,993

(22) Filed: Sep. 11, 2000

(30) Foreign Application Priority Data

Sep. 10, 1999 (DE) ..... 199 43 272

(51) Int. Cl.[7] ..... B21D 37/16
(52) U.S. Cl. ..... 72/342.3; 72/342.2
(58) Field of Search ..... 72/342.2, 342.3, 72/342.7

(56) References Cited

U.S. PATENT DOCUMENTS 3,668,917 A * 6/1972 Komatsu et al. ..... 72/342.3
4,112,732 A * 9/1978 Okunishi et al. ..... 72/342.3
4,122,700 A * 10/1978 Granzow ..... 72/342.3
4,502,313 A * 3/1985 Phalin et al. ..... 72/342.3
4,854,152 A 8/1989 Portmann

FOREIGN PATENT DOCUMENTS

DE 3839092 * 5/1990 ..... 72/342.3
JP 5-261450 * 10/1993 ..... 72/342.3
SU 1581419 * 7/1990 ..... 72/342.3

* cited by examiner

*Primary Examiner*—Ed Tolan
(74) *Attorney, Agent, or Firm*—Crowell & Moring LLP

(57) ABSTRACT

A forming machine has a thermostatic system which preferably utilizes a latent heat cooling medium as a coolant. The thermostatic system acts particularly upon parts of the forming machine that are critical with respect to the working quality or precision. These are, for example, the tool and/or the basic frame. Other parts, such as the drive, can be included.

18 Claims, 4 Drawing Sheets

FORMING MACHINE WITH COOLING APPARATUS

Forming machines, such as presses for massive forming or for sheet metal working, for example, for deep drawing or working of sheet metal parts in several stations, such as large-piece station presses, have tools with two tool halves which must work into one another at a relatively high precision. Although the moved tool half carries out relatively large strokes with respect to the tool size, and large forces act between the tool halves during the forming operation, the positioning of the tool halves with respect to one another has to take place in a precise manner. This applies particularly to tools with narrow function-defining gaps, as during cold extrusion, in the case of presses with several forming stations in one tool, as, for example, during massive forming, as well as in the case of large-piece station presses in which relatively thin-walled sheet metal parts are to be formed in a precise manner. Also in the case of punching machines, the precise positioning and guiding of upper dies with respect to a lower die may have increasing importance. This is particularly true when very narrow die clearances are desired.

From German Patent Document DE 3813235 C2, a special slide guidance for a fast-running punching machine is known, in the case of which the slide is constantly lubricated by correspondingly fed oil.

Increased precision demands cannot be met by lubrication alone.

Based on the above, it is an object of the invention to provide a forming machine which permits an improved working precision.

The forming machine according to the invention has at least a basic frame and a tool carried by the latter for forming workpieces. The workpiece tool) has, for example, a tool half carried by a slide and a tool half carried by the basic frame. For improving the working precision, particularly also during an operation of the forming machine for longer time periods, a cooling device is provided on the forming machine which is connected in a heat-transmitting manner at least with the basic frame or the tool. In this case, it may be sufficient for the cooling device to be connected only with one or a few parts of the basic frame and/or sections or parts of the tool in order to keep these cool and thus prevent a change of the dimensions as a result of temperature-caused extensions.

If the basic frame, for example, in the case of a large-piece station press is constructed of press stands and other parts, such as headpieces and bedplates, it may be sufficient to cool the press stands. As a result, the distance between the bedplate and the headpiece is maintained relatively precisely irrespective of the ambient temperature, whereby, in turn, during the closing of the tool, the gap existing between the two tool parts is maintained in a precise manner. Furthermore, it may be important to stabilize the dimension of a forming machine having several press stations in the passage or longitudinal direction in that carriers, which extend along several press stations, are each provided with at least one cooling duct and are therefore cooled. The bedplates and the headpieces can be included in the cooling as required. "Cooling" means that heat is dissipated from the corresponding parts irrespective of whether the temperature of the cooled part is above or below the ambient temperature.

The cooling, which can be provided as required, of a tool half, for example, of the lower tool, can be advantageous, for example, in the case of tools for massive forming. If the lower tool comprises several tool stations which are assigned, for example, to four successive forming stations, it can be prevented by means of the cooling that the lower tool heats up excessively during the running production and results in a change of the center distance of the individual tool stations. This permits a working with relatively narrow gaps between the upper tool and the lower tool and makes it possible to obtain particularly thin wall thicknesses during cold extrusion, an increased precision during massive forming and an improved endurance of the tools.

In every case, that is, when cooling the basic frame or its parts, as well as when cooling the tool or its parts, it is advantageous for the cooling device to be constructed as a thermostatic device. This means that the cooling performance is increased in the case of an increased heat output and an increasing temperature so that a defined limit temperature of the cooled parts is not exceeded. Here, it is particularly advantageous for the cooling device to be constructed as a latent-heat cooling system. This system contains a cooling medium which can absorb or deliver a larger amount of heat at a defined temperature, without changing its temperature in this case. The heat absorption can be connected with a phase transition (solid/liquid or liquid/gaseous). However, as an alternative and preferably, a cooling fluid is provided which is liquid above as well as below the defined latency temperature.

If its heat absorption capacity is sufficient, such a latent-heat cooling system permits maintaining the corresponding cooled areas of the tool or of the basic frame at a constant temperature. In particular, no temperature gradient occurs along the cooling duct by heating the coolant. Because of the uniform temperature, this permits an increased precision when guiding and positioning the movable tool part and the working of the tool part at a uniform temperature level. This allows the maintaining of narrow tolerances, which also applies to the cooling of a press frame by means of a latent-heat cooling system. In every case, it is expedient for the heat quantity to be absorbed by the latent-heat cooling medium on its path through the cooling duct to be lower than the latent heat quantity which can be absorbed. In addition, it is expedient to provide that, when entering into the cooling duct, the latent heat cooling medium already has the latent temperature but carries no latent heat or almost no latent heat yet. Thus, it is prevented that the beginning of the coolant duct becomes too cold.

The latent heat cooling medium can flow through the cooling duct and the cooling duct can also be constructed as a chamber with a resting latent heat cooling medium. In the latter case, one or several heat elimination ducts lead through the chamber filled with the latent head cooling medium or in its proximity in the thermal contact with the latter through the corresponding part. The latent heat cooling medium, whether it flows through a cooling duct or is situated in a corresponding chamber, is used for holding the corresponding tool or the corresponding part of the frame at a uniform temperature.

The carrying-away of heat from the cooling medium, particularly the latent heat cooling medium, preferably takes place by means of a heat exchanger. If the latent heat cooling medium is pumped through the cooling duct, it is circulated through the heat exchanger in order to supply its stored latency heat. As required, it can also be heated in the heat exchanger in order to bring the tool to the desired working temperature already at the start of the operation. This also applies to a basic frame or parts thereof.

For monitoring the latent heat cooling system, it is expedient to provide a heat capacity sensing device in the cooling duct and/or at its beginning and/or at its end which detects whether or not the latent heat cooling medium is capable of absorbing heat. The latent heat cooling medium forms a latent heat accumulator so that the corresponding parts of the forming machine which are penetrated by the cooling duct are connected with the thus formed latent heat accumulator. The charging and discharging of the latent heat accumulator will then be controlled by a control device which controls, for example, a coolant pump for circulating the latent heat accumulator medium. In the embodiment with the standing latent heat accumulator medium and the additional cooling duct, the circulation of the cooling medium in the additional cooling duct can be controlled. In addition, as required, the control device can act upon a heat exchanger or a device for carrying away heat connected here, in order to ensure the operation of the corresponding parts of the forming machine with latency temperature.

Detail of advantageous embodiments of the invention are contained in the drawing, the description or the subclaims. The drawing illustrates embodiments of the invention.

Figure 1:
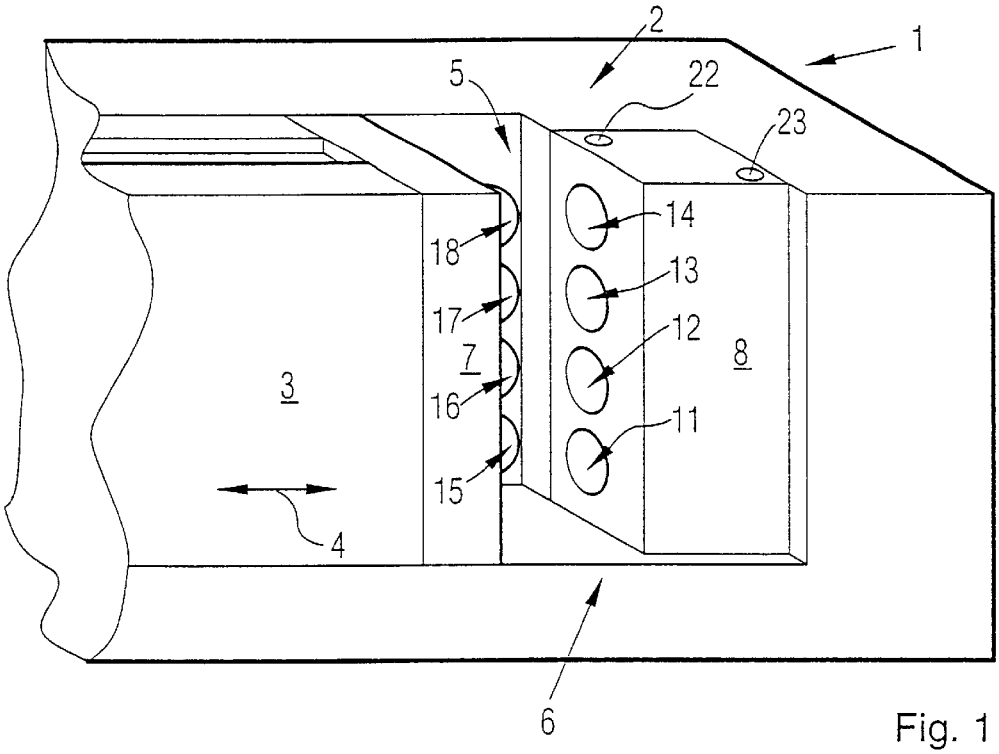
FIG. 1 is a schematic, perspective and cutout-type view of a press for massive forming.

FIG. 1 illustrates a section of a press 1 for massive forming which has a basic frame 2 with a movably disposed slide 3. The slide 3 can be moved back and forth in a direction which is illustrated in FIG. 1 by means of an arrow 4. The basic frame 2 and the slide 3 define a tool receiving space 5 in which a tool 6 is arranged. Two tool parts 7, 8 pertain to the tool. Tool part 8 is constructed as a lower die and is stationarily disposed on the basic frame 2. Tool part 7 is constructed as an upper die and is connected with the slide 3 in order to be moved back and forth by means of this slide 3.

Figure 2:
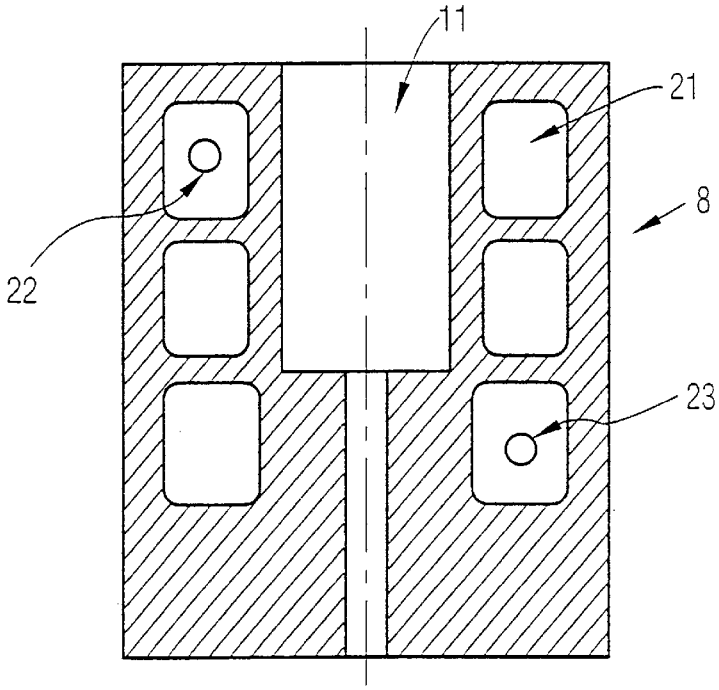
FIG. 2 is a sectional view of a different scale of a tool part of the tool of the forming machine according to FIG. 1.
Figure 4:
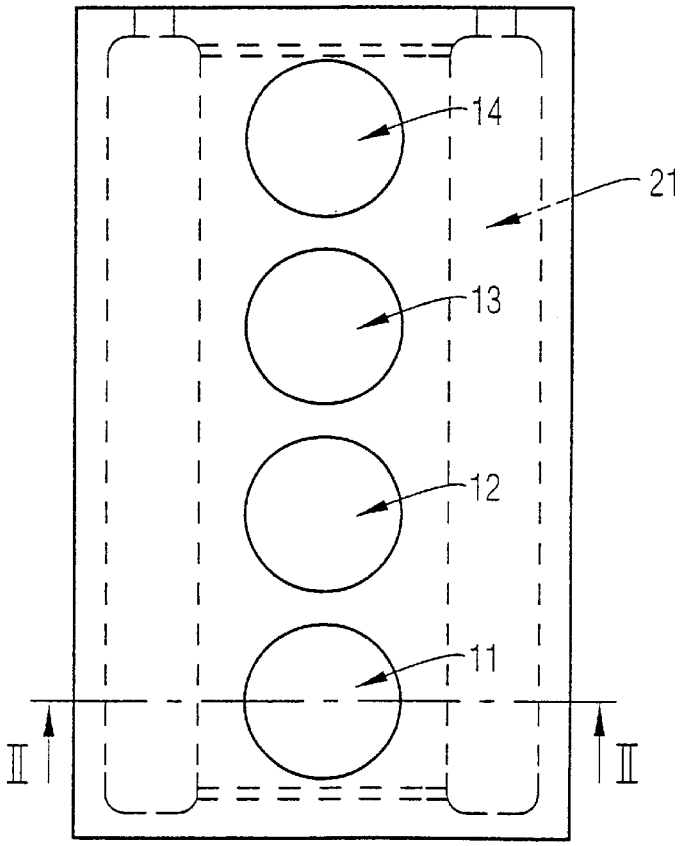
FIG. 4 is a top view of the tool of the forming machine according to FIG. 1.

Tool part 8 is illustrated separately in FIGS. 2 and 4. It has several dies 11, 12, 13, 14, to which upper dies 15, 16, 17, 18 on tool half 7 are assigned. The center distance of two adjacent dies 11, 12 may, for example, be in the order of 200 mm. According to the precision requirement, this center distance should be observed as accurately as possible, for example, up to 0.001 mm.

Tool part 8 is provided with a cooling duct 21 which extends through the body of tool part 8 and past the dies 11, 12, 13, 14. The cooling duct 21 has an inlet connection 22 and an outlet connection 23 which are used for feeding and discharging coolant. The coolant should first be used for carrying away the heat released in the dies 11, 12, 13, 14 during the forming of workpieces inserted here.

Figure 5:
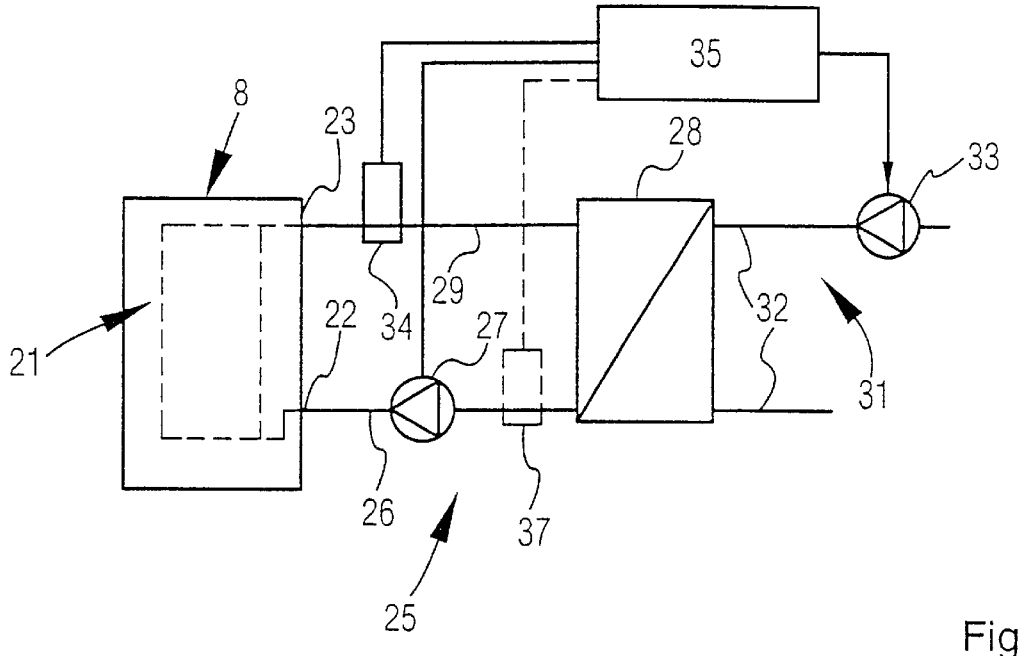
FIG. 5 is a schematic view of the tool of the forming machine according to FIG. 1 and its pertaining latent heat cooling system.

A cooling system 25 constructed for this purpose is illustrated in FIG. 5 and includes the cooling duct 21 of tool part 8. A pipe 26 is connected to the inlet connection 22 and is acted upon by coolant by means of a pump 27. The pipe 26 originates from a heat exchanger 28. By way of a pipe 29, the outlet connection 23, in turn, is connected with the heat exchanger 28. The heat exchanger 28 has the purpose of maintaining the cooling medium at a defined temperature. It can, for example, be air-cooled or connected to another cooling circulating system 31. In the present embodiment, the heat exchanger 28 is cooled by a liquid cooling medium which is fed and removed in corresponding pipes 32. The controlling of the flow-through takes place by way of a pump 33. As required, a preheating of tool part 8 can also take place by way of the cooling system 25 if the operating temperature is too low before the start of the operation.

The pipe 29 which leads from the tool part 8 to the heat exchanger 28 is connected with a temperature sensor or, in the present example, with a heat quantity sensor 34. The heat quantity sensor 34, the circulating pump 27 and the circulating pump 33 are controlled by means of a superimposed control unit 35 which is set up for maintaining the tool part 8 at an essentially constant temperature. This can take place, for example, by controlling the temperature at the pipe 29. However, this preferably takes place by controlling the absorbed heat quantity. For improving the control as required, another heat quantity sensor 37 can be arranged on the pipe 26 leading to tool part 8. The heat quantity sensor 37 is then also connected with the control device 35.

Figure 6:
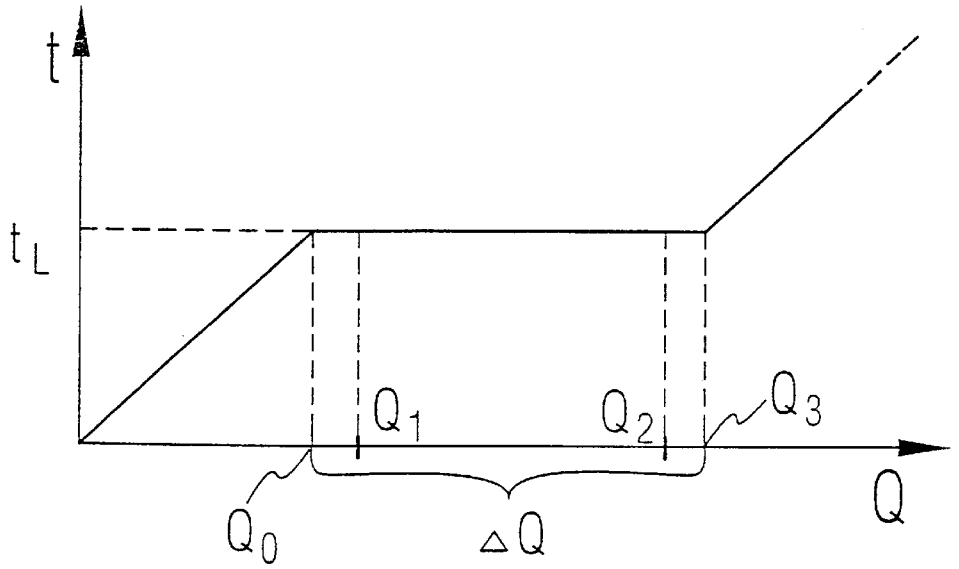
FIG. 6 is a view of a characteristic curve of a latent heat cooling medium.

The cooling system 37 is preferably constructed as a latent heat accumulator and a latent heat cooling system. A latent heat cooling medium is provided as the coolant in the circulation system constructed between the tool part 8 and the heat exchanger 28. Its characteristic curve is shown in FIG. 6. In this case, it is assumed that, in the working range that is of interest, the latent heat cooling medium is liquid. It has a latent heat temperature $t_L$ and has accumulated the heat quantity $Q_0$ when this latent heat temperature $t_L$ has been reached. If it continues to store heat, the temperature of the latent heat cooling medium will not change but remain constant at $t_L$. The temperature t begins to rise further only starting from a heat quantity $Q_3$. The difference between the heat quantity $Q_0$ and the heat quantity $Q_3$ is $\Delta_Q$. This heat quantity $\Delta_Q$ can be maximally absorbed or supplied by the latent heat cooling medium without any change of the temperature t.

The controlling of the cooling system 25 takes place by means of the control device 35 such that the latent heat cooling medium is charged from the pump 27 by way of the pipe 26 at a temperature $t_L$ and a heat quantity Q into the tool part which is close to $Q_0$. The heat quantity of the inflowing latent heat cooling medium is, for example, $Q_1$. This is controlled by the control device 35 by way of the latent heat sensor 37 and the heat withdrawal into the heat exchanger 28 by controlling the circulating pump 33. In tool part 8, the latent heat cooling medium will now absorb heat, in which case the control device 35 implements the process such that the latent heat cooling medium in pipe 29 has no heat content exceeding $Q_3$. For example, the latent heat sensor 34 is queried and, by means of the output value, the circulating pump 27 is controlled such that $Q_2$ is not exceeded. If the heat content of the latent heat cooling medium in pipe 29 approaches the value $Q_2$, the rotational speed of the circulating pump 27, that is, its pumping effect, is increased so that the coolant flow increases and the time for the absorption of heat in the tool part 8 is shortened. Correspondingly, the delivery effect of the circulating pump 33 is increased when the latent heat cooling medium leaving the heat exchanger 28 has an excessive heat content. In contrast, if it is too low, its rotational speed or pumping effect is reduced.

Figure 3:
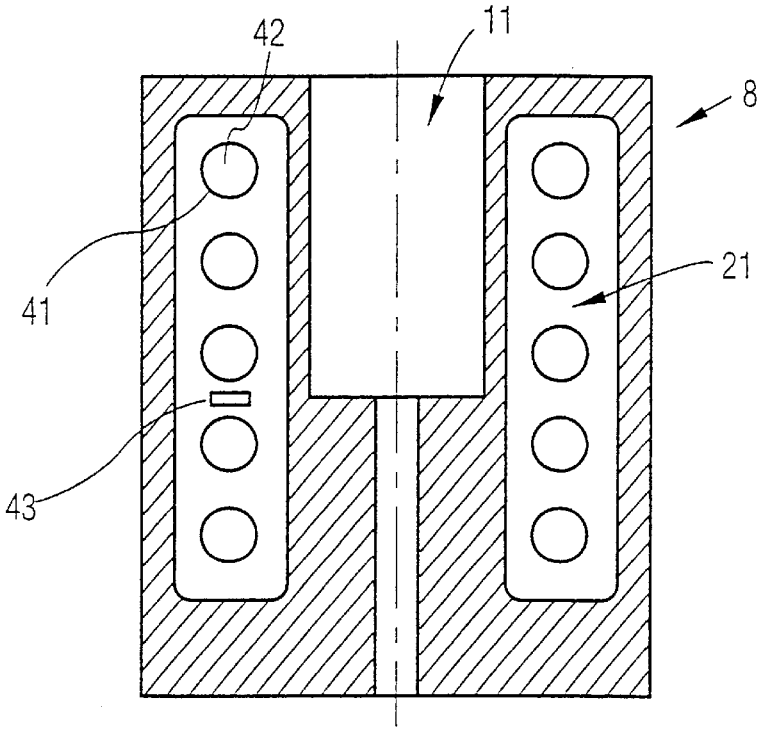
FIG. 3 is a sectional view of a modified embodiment of a tool for a forming machine according to FIG. 1.

The cooling duct 21 of tool part 8 is open, that is, the latent heat cooling medium flows through it. As an alternative, it may have a closed construction, as illustrated in FIG. 3. To the extent that there is agreement with the tool part 8 according to FIG. 2, the same reference numbers are used. The differences are the following:

The cooling duct 21 has no inlet connection 22 and no outlet connection 23. It is constructed as a closed chamber which can form a cohesive volume or one which is divided once or several times and is filled with the latent heat cooling medium. A pipe coil 41 or several pipes which define a heat dissipation duct 42 lead through the chamber formed by the cooling duct 21. This heat dissipation duct 42 is connected to the exterior cooling system 25 according to FIG. 5. In the chamber formed by the cooling duct 21, one or several heat capacity sensors (latent heat sensors 43) can be housed which are connected to the control device 35 and control the carrying-away of heat through the heat dissipation duct 42. The exterior sensors 34, 37 can be eliminated or, as required, can be replaced by temperature sensors.

During the operation of the press 1, the cooling system 25 is used for maintaining the tool part 8 at a constant temperature. This takes place along the entire cooling duct 21, that is, along its whole length (vertically in FIG. 4). Despite the heat absorption, the latent heat cooling medium permits no temperature increase, as long as it is operated in its latent heat cooling range $Q_0$, $Q_3$. The control device 35 regulates the operation of the cooling system 25 such that the latent heat cooling range $Q_0$, $Q_3$ is not left. Because of the uniform tool temperature and the time-related constancy of this temperature, the tool geometry is subjected to no temperature-caused changes or at most to only very slight temperature-caused changes. This permits a higher manufacturing quality, a defining of narrower tolerances for the tool and an improved endurance.

In addition, cooling ducts can be provided in the basic frame 2, the slide 3 and/or the tool part 7, which cooling ducts are included in the cooling system 25 or are supplied with the same or a different latent heat cooling medium by separate cooling systems. It is also possible to combine a latent heat cooling system with a cooling system with a conventional coolant.

Figure 7:
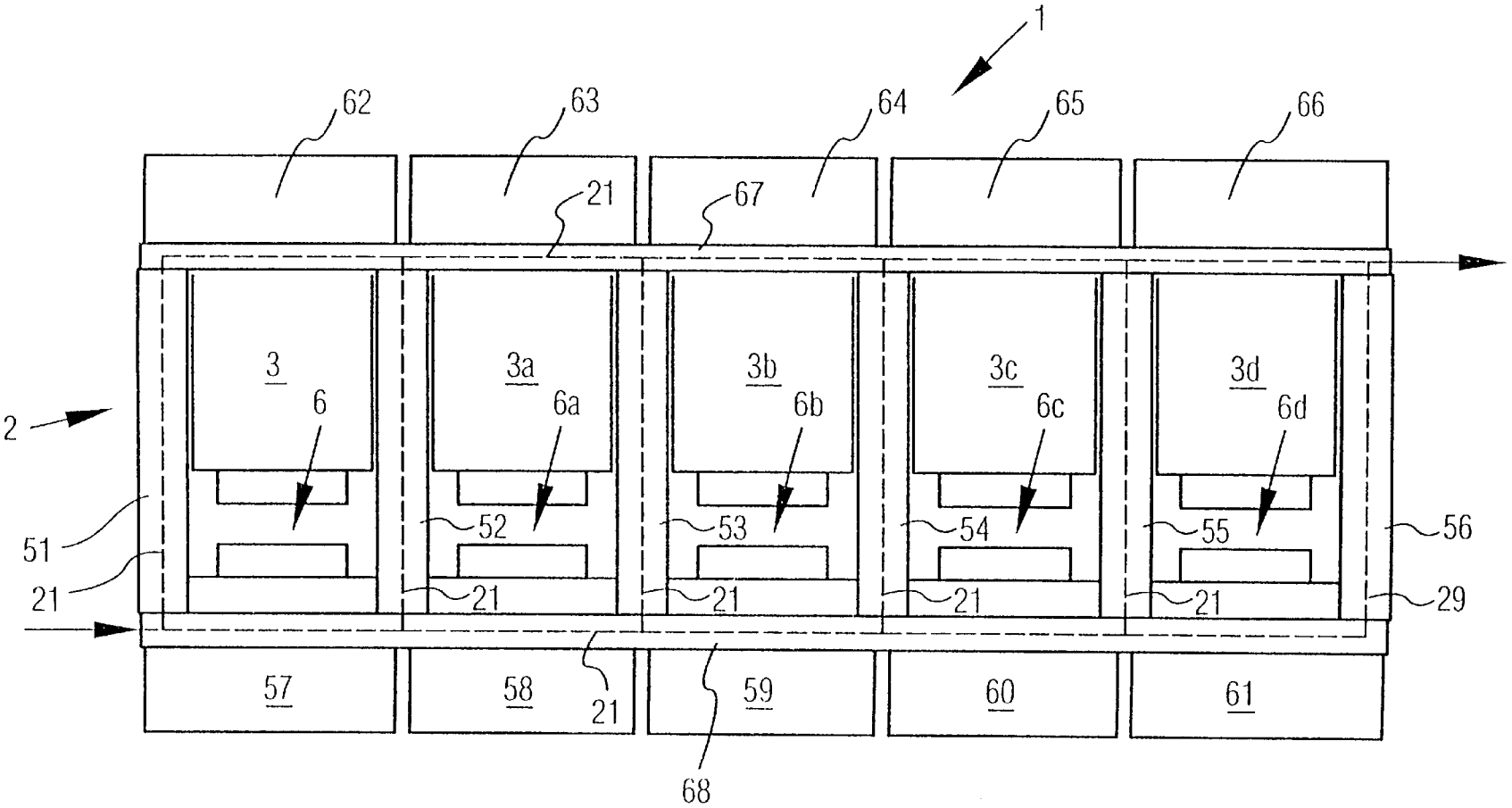
FIG. 7 is an extremely schematic lateral view of a forming machine which is constructed as a large-piece station press and has a latent heat cooling system assigned to the press frame.

The cooling of the basic frame 2 can be significant, particularly in the case of large-piece station presses 1, as schematically illustrated in FIG. 7. The large-piece station press 1 has a basic frame 2, a press frame with press stands 51, 52, 53, 54, 55, 56 which are vertically arranged and stand indirectly or directly on bedplates 57, 58, 59, 60, 61. At the top, the press stands 51 to 56 carry headpieces 62, 63, 64, 65, 66. The headpieces carry individual slides 3, 3*a*, 3*b*, 3*c*, 3*d* which each define a press station. As an alternative, one slide can also be provided which is carried by several headpieces and spans several stations. In an extreme case, a single slide can be provided which spans all stations. Correspondingly, one tool 6, 6*a*, 6*b*, 6*c*, 6*d* respectively or a continuous tool are fastened on the slides 3 to 3*d* and the respective bedplate 57 to 61.

The press frame can include longitudinal supports 67, 68 which are arranged essentially horizontally above and below the press stands 51 to 56. In the case of the illustrated large-piece station press having five individual stations, six press stands 51 to 56 and two longitudinal supports 67, 68, that is, a total of twelve press stands and four longitudinal supports, are provided on each side. The longitudinal supports can be eliminated as required.

The press stands 51 to 56 are each provided with at least one cooling duct 21 respectively. The cooling duct 21 can be constructed in that the press stands 51 to 56 are formed of mutually fluid-tightly welded-together sheet metal parts which each enclose an interior. On the upper and the lower face of the respective press stand 51 to 56, this interior is connected to pipes for feeding and removing coolant, preferably latent heat cooling medium. If longitudinal supports 67, 68 exist, these pipes can, as required, be formed by these supports. As a result, the longitudinal supports 67, 68 also contain cooling ducts 21. The cooling ducts 21 of the press stands 51 to 56 can therefore be connected parallel to one another, the longitudinal support 68 acting as a forward-flow distributor and the longitudinal support 67 acting as a return-flow distributor. However, the flow can also be reversed.

By including the basic frame 2 into the cooling system according to FIG. 5, which is constructed as a thermostatically operating device, the basic frame 2 of the large-piece station press 1 is under a thermostatic effect. Largely independently of the ambient temperature, the temperature of the dimension-relevant parts of the basic frame 2 is maintained to be constant locally as well as with respect to time, which permits a particularly precise working of the tools 6 to 6*d*. In addition, the tools 6 to 6*d* or individual tools can be under a thermostatic effect by means of the above-described system 25.

A forming machine 1 has a thermostatic system 25 which preferably uses a latent heat cooling medium as a coolant. The thermostatic system acts particularly upon parts of the forming machine which are critical with respect to the working quality or precision. These are, for example, the tool 6 and/or the basic frame 2. Other parts, such as the drive, can be included.

What is claimed is:

1. Forming machine, particularly a press or press system, comprising a basic frame for absorbing and carrying away forces occurring during workpiece forming, at least one tool operatively carried by the basic frame for forming workpieces, a cooling device with at least one cooling duct heat transmittingly connected with at least the basic frame or the tool such that a medium is selected so as to be in a liquid phase in an operational range of the cooling device whereby the medium maintains a substantially constant temperature during heat exchange with the basic frame or tool in the operational range.

2. Forming machine according to claim 1, wherein press stands are connected with one another as part of the basic frame, and at least the press stands are each provided at least with the at least one cooling duct containing coolant medium.

3. Forming machine according to claim 1, wherein a plurality of press stations are provided and the basic frame includes supports extending longitudinally along at least several of the press stations and each being provided with the at least one cooling duct containing coolant medium.

4. Forming machine according to claim 1, wherein the basic frame includes at least one bedplate, press stands and at least one headpiece operatively connected with one another and each having the at least one cooling duct containing coolant medium.

5. Forming machine according to claim 1, wherein the at least one tool comprises an upper tool part and a lower tool part, and at least the lower tool part is provided with the at least one cooling duct.

6. Forming machine according to claim 1, wherein the cooling device comprises a thermostatic device.

7. Forming machine according to claim 1, wherein the medium is a liquid latent heat cooling medium in the at least one cooling duct and has, in a liquid phase thereof, a latent heat absorption range in which a temperature thereof remains substantially constant during heat absorption and heat dissipation.

8. Forming machine according to claim 7, wherein a working temperature of the latent heat cooling medium is related to the temperature corresponding to the latent heat absorption range.

9. Forming machine according to claim 1, wherein the medium is a latent heat cooling medium in the at least one cooling duct and has a phase transition with an essentially constant phase transition temperature, a working temperature of the latent heat cooling medium being related to the phase transition temperature.

10. Forming machine according to claim 8, wherein the cooling device comprises a cooling circulating system including the at least one cooling duct and a heat exchanger operatively arranged to withdraw heat from the latent heat cooling medium.

11. Forming machine according to claim 9, wherein the cooling device comprises a cooling circulating system including the at least one cooling duct and a heat exchanger operatively arranged to withdraw heat from the latent heat cooling medium.

12. Forming machine according to claim 8, wherein the cooling device comprises a cooling circulating system having the at least one cooling duct and a heat exchanger operatively arranged to heat to the latent heat cooling medium.

13. Forming machine according to claim 9, wherein the cooling device comprises a cooling circulating system having the at least one cooling duct and a heat exchanger operatively arranged to heat to the latent heat cooling medium.

14. Forming machine according to claim 10, wherein the cooling device is dimensioned such that a heat quantity to be absorbed by the latent heat cooling medium on a path thereof through the at least one cooling duct is lower than a predetermined latent heat quantity.

15. Forming machine according to claim 8, wherein the at least one cooling duct has at least one coolant chamber closed toward an outside thereof and filled with latent heat cooling medium, and the coolant chamber is thermally connected with at least one heat dissipation duct through which a cooling medium flows.

16. Forming machine according to claim 9, wherein the at least one cooling duct has at least one coolant chamber closed toward an outside thereof and filled with latent heat cooling medium, and the coolant chamber is thermally connected with at least one heat dissipation duct through which a cooling medium flows.

17. Forming machine according to claim 1, wherein the at least one cooling duct is thermally connected with at least one heat capacity sensing device operatively connected to a control device.

18. Forming machine according to claim 17, wherein the control device is operatively arranged to control a device for removing heat from cooling medium.

* * * * *